US006405421B1

(12) United States Patent
Tang

(10) Patent No.: US 6,405,421 B1
(45) Date of Patent: Jun. 18, 2002

(54) DIE ASSEMBLY FOR RIVETING

(75) Inventor: Zhi Neng Tang, Shenzhen (CN)

(73) Assignee: Hon Hai PrecisionInd. Co., Ltd., Taipei Hsien (TW)

( * ) Notice: Subject to any disclaimer, the term of this patent is extended or adjusted under 35 U.S.C. 154(b) by 10 days.

(21) Appl. No.: 09/753,776

(22) Filed: Jan. 3, 2001

(51) Int. Cl.[7] ..... B23P 11/00

(52) U.S. Cl. ..... 29/243.53; 29/812.5; 29/243.54; 72/391.4

(58) Field of Search ..... 27/243.53, 243.54, 27/524.1, 812.5, 816; 72/391.4, 391.6

(56) References Cited

U.S. PATENT DOCUMENTS 3,600,928 A * 8/1971 Retherford ..... 72/416
3,948,427 A * 4/1976 Claydon ..... 227/97
4,736,507 A * 4/1988 Bereez ..... 29/243.53
5,040,278 A * 8/1991 Eckold et al. ..... 29/243.53
5,046,228 A * 9/1991 Eckhold et al. ..... 29/243.53
5,060,362 A * 10/1991 Birke ..... 29/525.2
5,177,861 A * 1/1993 Sawdon ..... 29/798
5,277,049 A * 1/1994 Endo ..... 72/391.4
5,279,024 A * 1/1994 Zieve ..... 29/243.53
6,041,493 A * 3/2000 Donhauser ..... 29/715
6,266,871 B1 * 7/2001 Edwards ..... 29/818
6,276,050 B1 * 8/2001 Mauer ..... 29/716

* cited by examiner

*Primary Examiner*—Joseph J. Hail, III
*Assistant Examiner*—Daniel Shanley
(74) *Attorney, Agent, or Firm*—Wei Te Chung

(57) ABSTRACT

A die assembly (20) for riveting includes an upper die (200), a base die (230), a pair of clamps (270), and a pair of springs (280). The upper die includes a fixing block (202), and a pair of pressing protrusion (204) at opposite sides of the fixing block and having first slanted surfaces (206). The base die includes a sizing block (232) to position a workpiece. Two supporting blocks (234) are formed at opposite sides of the sizing block, each defining a through hole for accommodating the clamp. Two positioning blocks (240) are at opposite sides of the supporting blocks. Each clamp includes an end block (276) having a second slanted surface (278) corresponding to the first slanted surface of the pressing protrusion, and a connecting portion (272) slidable in the through hole of the supporting block. The springs connect the clamps to the positioning blocks.

8 Claims, 6 Drawing Sheets

DIE ASSEMBLY FOR RIVETING

BACKGROUND

1. Field of the Invention

The present invention relates to a die assembly for riveting, and particularly to a die assembly which can firmly and automatically rivet.

2. Related Art

FIG. 6 shows a conventional die assembly 10 for riveting which requires manual operation. The die assembly 10 includes an upper die 101, and a base die 105. A fixing block 102 is mounted to the upper die 101, corresponding to a sizing block 103 which is mounted to the base die 105. A pair of clamps 106 is positioned at opposite sides of the sizing block 103. A workpiece (not shown) is placed onto the sizing block 103. When power is turned on, the upper die 101 moves downwardly, and the fixing block 102 forces the workpiece against the sizing block 103. Then the clamps 106 rivet the workpiece. The clamps 106 are then pulled away from the workpiece, and the workpiece is unloaded from the die assembly 10.

Placing, riveting, and unloading the workpiece are all required to be done manually. Riveting requires an operator to use both hands. The procedure is labor-intensive and unduly inefficient, which results in high manufacturing costs. Moreover, manual riveting limits the amount of pressing force which can be applied. Rivets are too often not firmly secured.

Therefore an improved die assembly for riveting is desired to overcome the above-mentioned shortcomings of the related art.

SUMMARY OF THE INVENTION

Accordingly, an object of the present invention is to provide a die assembly for riveting which has a high level of automation.

Another object of the present invention is to provide a die assembly which can firmly rivet workpieces together.

To achieve the above-mentioned objects, a die assembly for riveting comprises an upper die, a base die, a pair of clamps, and a pair of springs. The upper die comprises a fixing block, and a pair of pressing protrusions at opposite sides of the fixing block. A first slanted surface is formed at an end of each pressing protrusion. The base die comprises a sizing block to position a workpiece. Two supporting blocks are formed at opposite sides of the sizing block, each defining a through hole for accommodating the clamp. Two positioning blocks are formed at opposite sides of the supporting blocks. Each clamp comprises an end block having a second slanted surface corresponding to the first slanted surface of the pressing protrusion, and a connecting portion slidable in the through hole of the supporting block. The springs connect the clamps to the positioning blocks.

Other objects, advantages and novel features of the present invention will be drawn from the following detailed embodiments of the present invention with attached drawings, in which:

DESCRIPTION OF THE PREFERRED EMBODIMENTS

Figure 1:
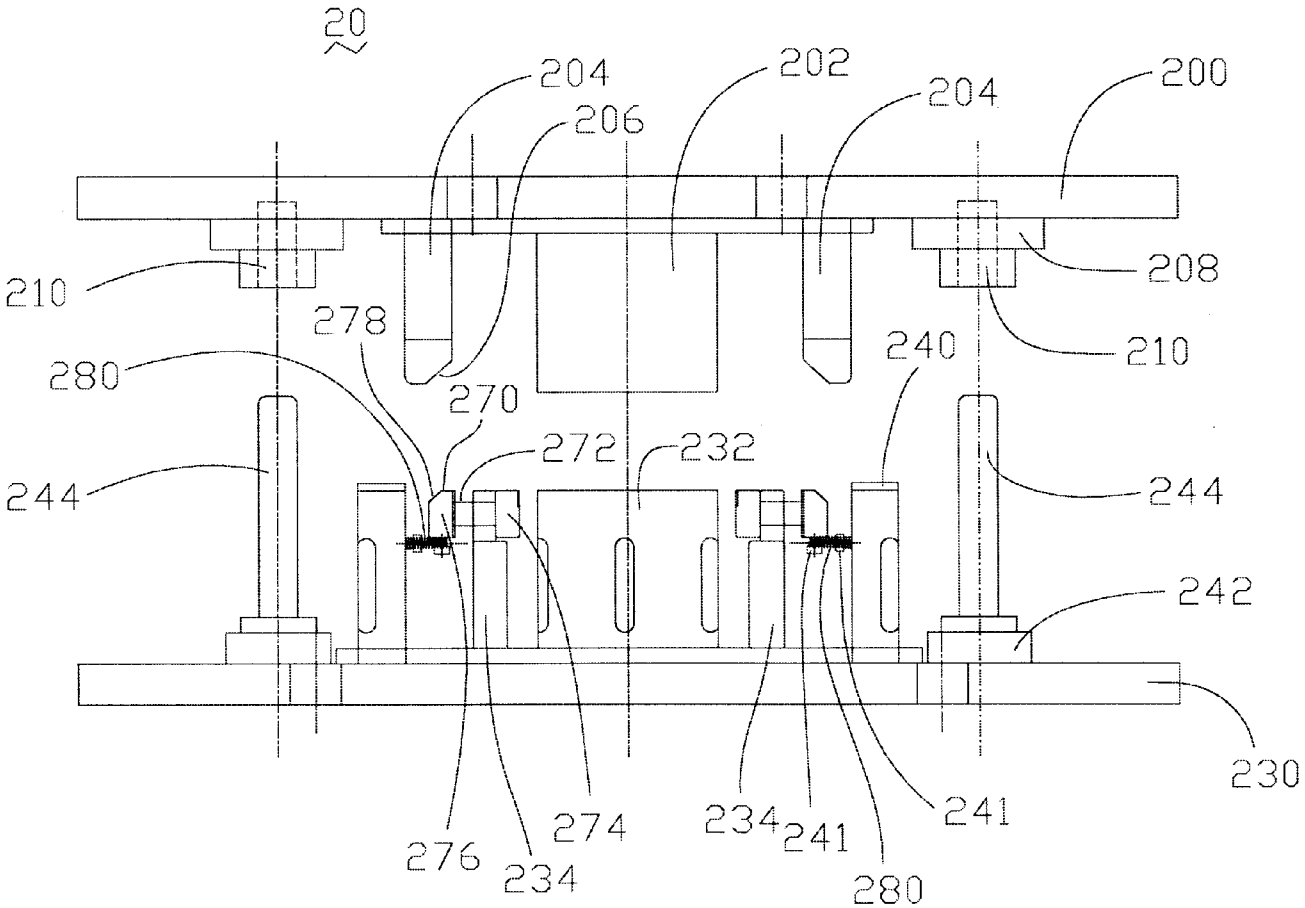
FIG. 1 is a schematic view of a die assembly for riveting in accordance with a preferred embodiment of the present invention.
Figure 2:
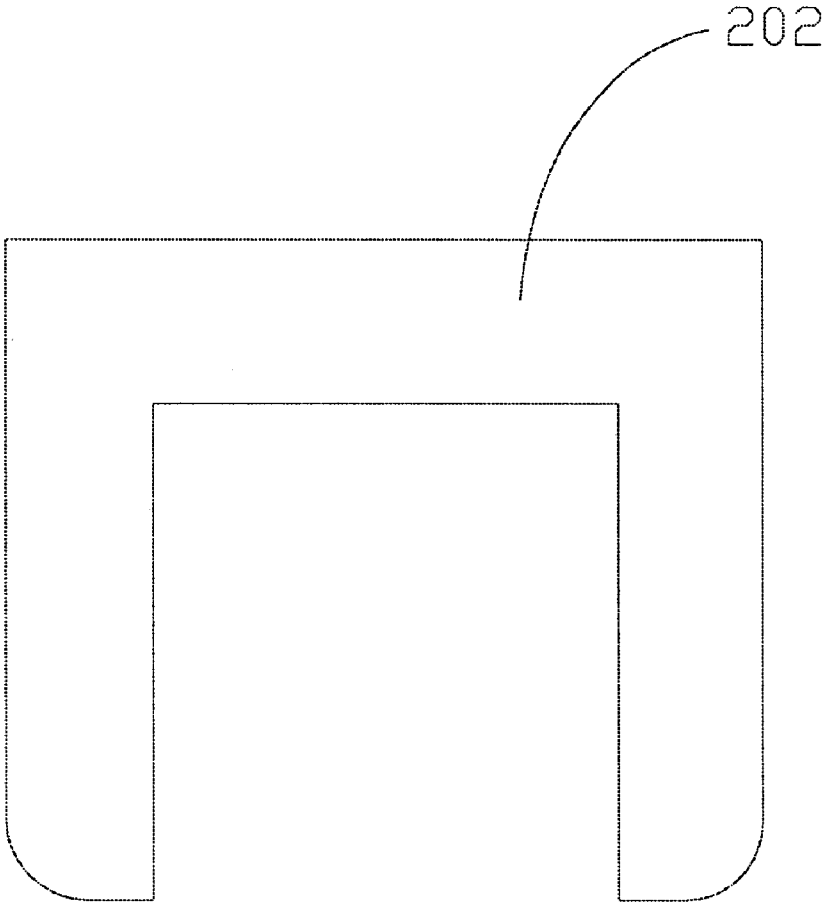
FIG. 2 is a side view of a fixing block o f the die assembly of FIG. 1.

Referring to FIGS. 1 and 2, a die assembly 20 for riveting in accordance with a preferred embodiment of the present invention comprises an upper die 200, a base die 230, two clamps 270, and two springs 280.

The upper die 200 comprises an U-shaped fixing block 202 depending from a center of the upper die 200 (see FIG. 2). The fixing block 202 defines a space (not labeled) therein for accommodating a workpiece (not shown) therein. A pair of pressing protrusions 204 depends from the upper die 200 at opposite sides of the fixing block 202. A first slanted surface 206 is formed at an inner side of a distal end of each pressing protrusion 204.

A pair of first stepped blocks 208 is positioned beside the pressing protrusions 204. A guiding hole 210 is defined at a center of each first stepped block 208. A depth of the guiding hole 210 is variable according to a size of the workpiece to be used.

The base die 230 comprises a sizing block 232 extending upwardly from a center thereof, corresponding to the fixing block 202 of the upper die 200. A pair of supporting blocks 234 extends upwardly from the base die 230 at opposite sides of the sizing block 232. An upper portion of each supporting block 234 is stepped, and defines a horizontal through hole (not labeled) therein. A positioning block 240 is formed at an outer side of each supporting block 234. An inner side wall of each positioning block 240 is in alignment with an outer side wall of the pressing protrusion 204, for positioning the pressing protrusion 204. A bolt 241 is fixed to an inner side wall of each positioning block 240. A pair of second stepped blocks 242 is positioned at opposite outer sides of the positioning blocks 240, corresponding to the first stepped blocks 208 of the upper die 200. A guiding pin 244 extends upwardly from each second stepped block 242, for entering the corresponding guiding hole 210 of the first stepped block 208.

Each clamp 270 comprises a press head 274, an end block 276, and a connecting portion 272 connecting the press head 274 and the end block 276. The connecting portion 272 is accommodated in and slideable along the horizontal through holes (not labeled) of the supporting block 234. A second slanted surface 278 is formed at an outer side of a distal end of each end block 276, corresponding to the first slanted surface 206 of the pressing protrusion 204. Another bolt 241 is fixed to a bottom end of each end block 276.

Figure 3:
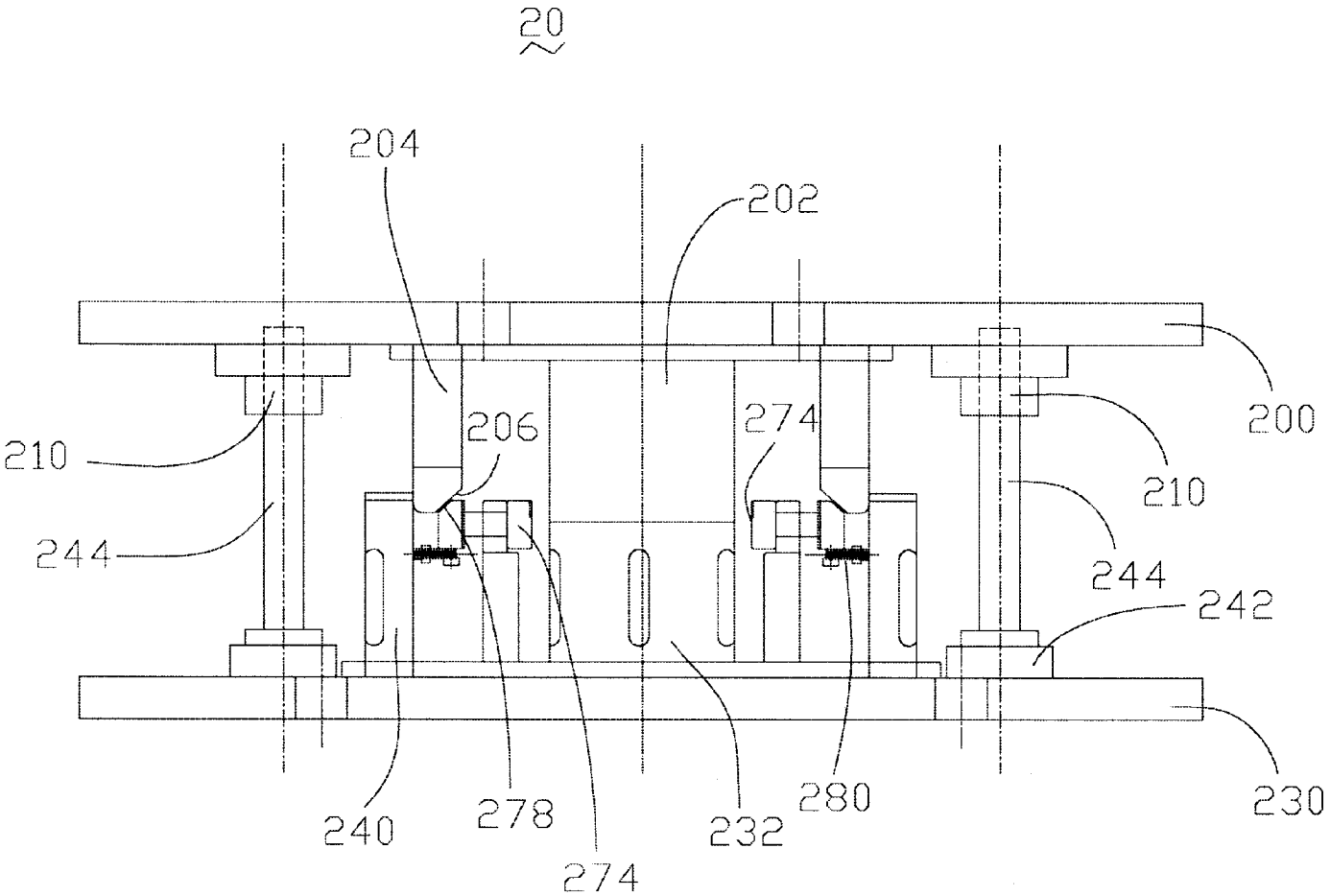
FIG. 3 is similar to FIG. 1, but showing the die assembly in a process of riveting.
Figure 4:
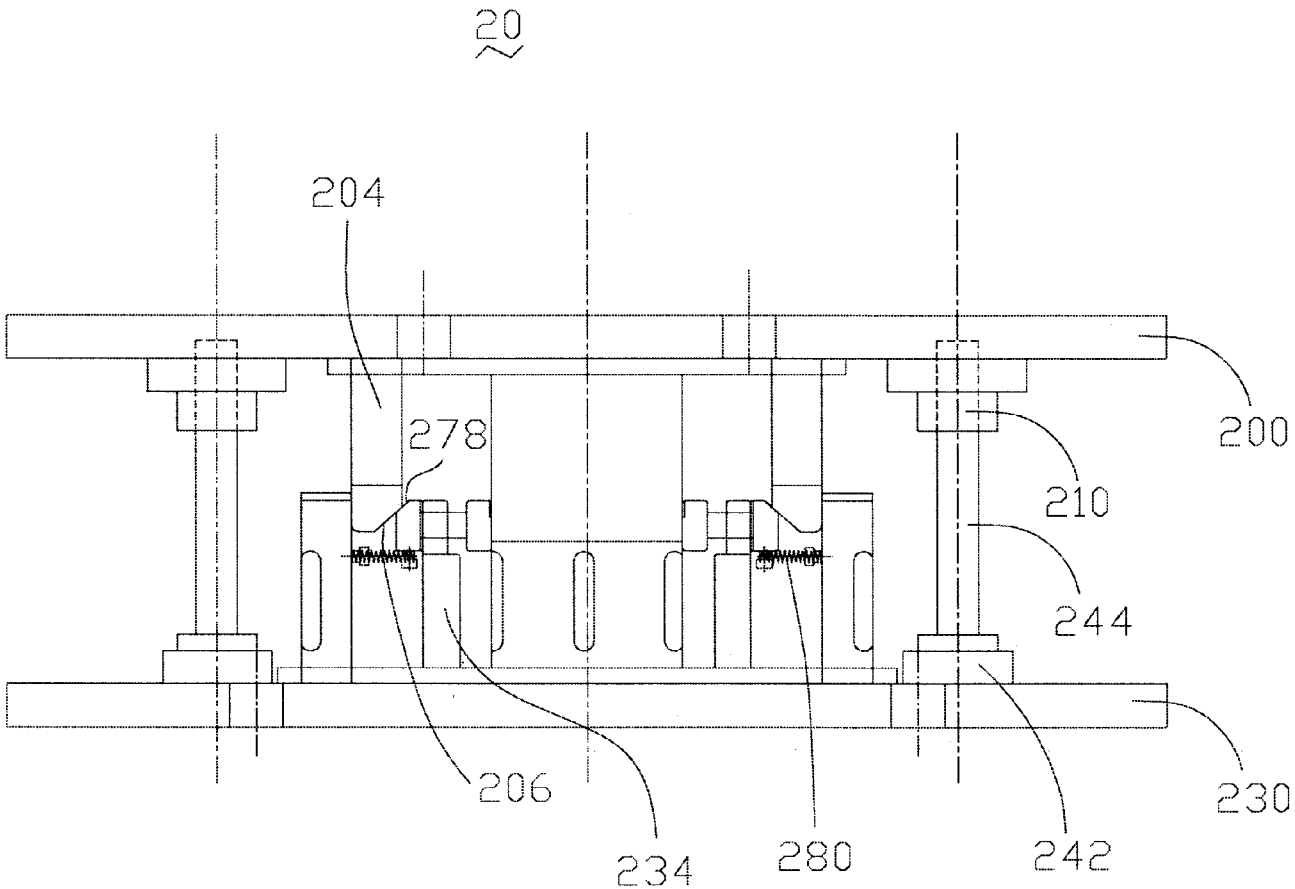
FIG. 4 is similar to FIG. 3, but showing the die assembly in a later stage of the process of riveting.

Each spring 280 is connected between the bolt 241 of the positioning block 240 and the bolt 241 of the end block 276. Referring also to FIGS. 3 and 4, the operation process comprises four steps as follows:

a. positioning the workpiece (not shown) on the sizing block 232;

b. switching on power (not shown) to drive the upper die 200 downwardly, the guiding pins 244 entering the corresponding guiding holes 210 of the upper die 200 for accurately guiding the downward movement of the upper die 200, the base block 232 and the workpiece being accommodated in the space of the fixing block 202, and the first slanted surface 206 of each pressing protrusion 204 abutting against the second slanted surface 278 of each clamp 270;

c. the upper die 200 being progressively moved downward along the inner side wall of the positioning block 240, the workpiece being forced against the base block 232 by the fixing block 202, the pressing protrusions 204 moving downwardly and pushing the corresponding clamps 270 to move horizontally inwardly via abutting of the first and second slanted surfaces 206, 278, the pressing heads 274 thereby riveting the workpiece, and the springs 280 being stretched;

d. the upper die 200 moving upwardly, the fixing blocks 202 and the pressing protrusions 204 leaving the corresponding base blocks 232 and the clamps 270, the springs 280 retracting and automatically pulling the clamps 270 away from workpiece, whereupon the workpiece is easily taken away from the die assembly by hand.

Figure 5:
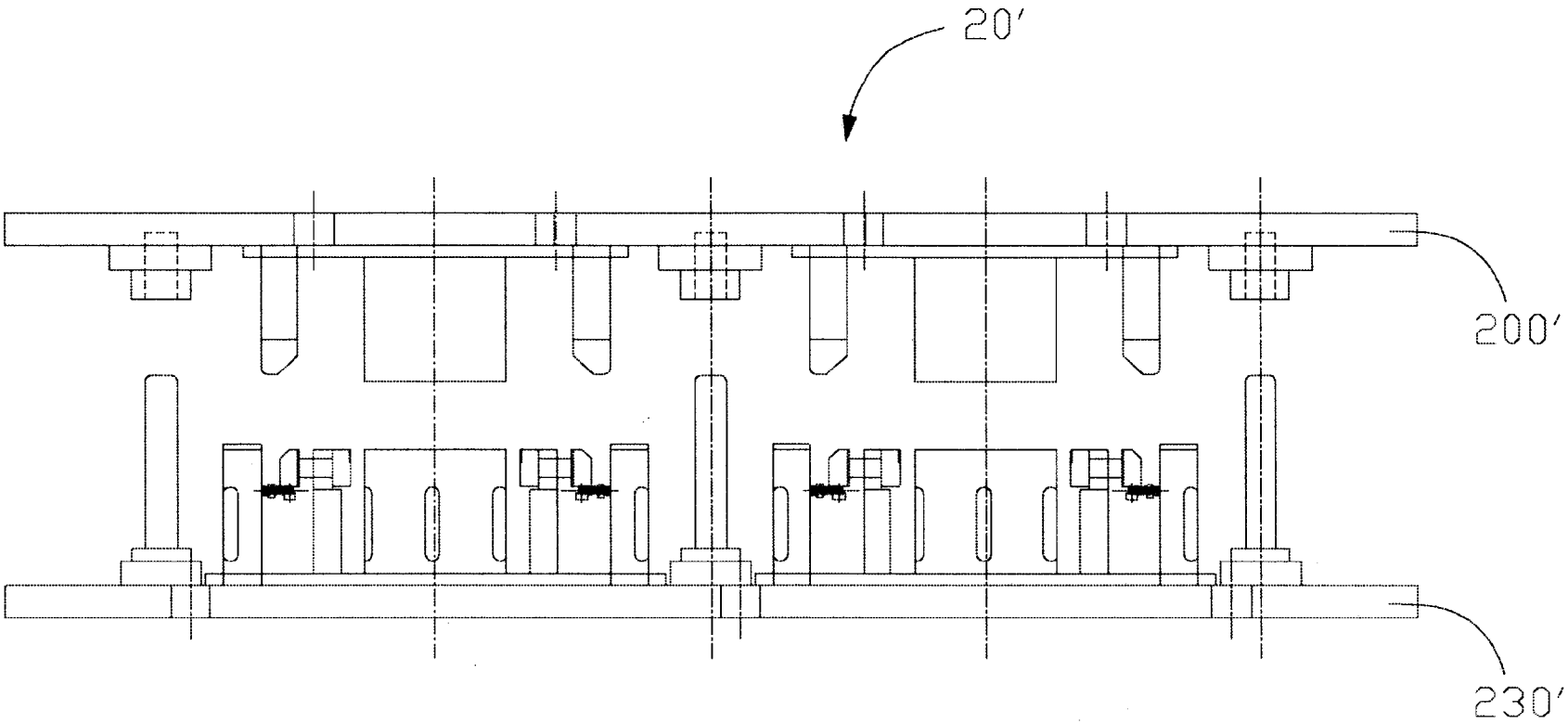
FIG. 5 is a schematic view of a die assembly in accordance with an alternative embodiment of the present invention.
Figure 6:
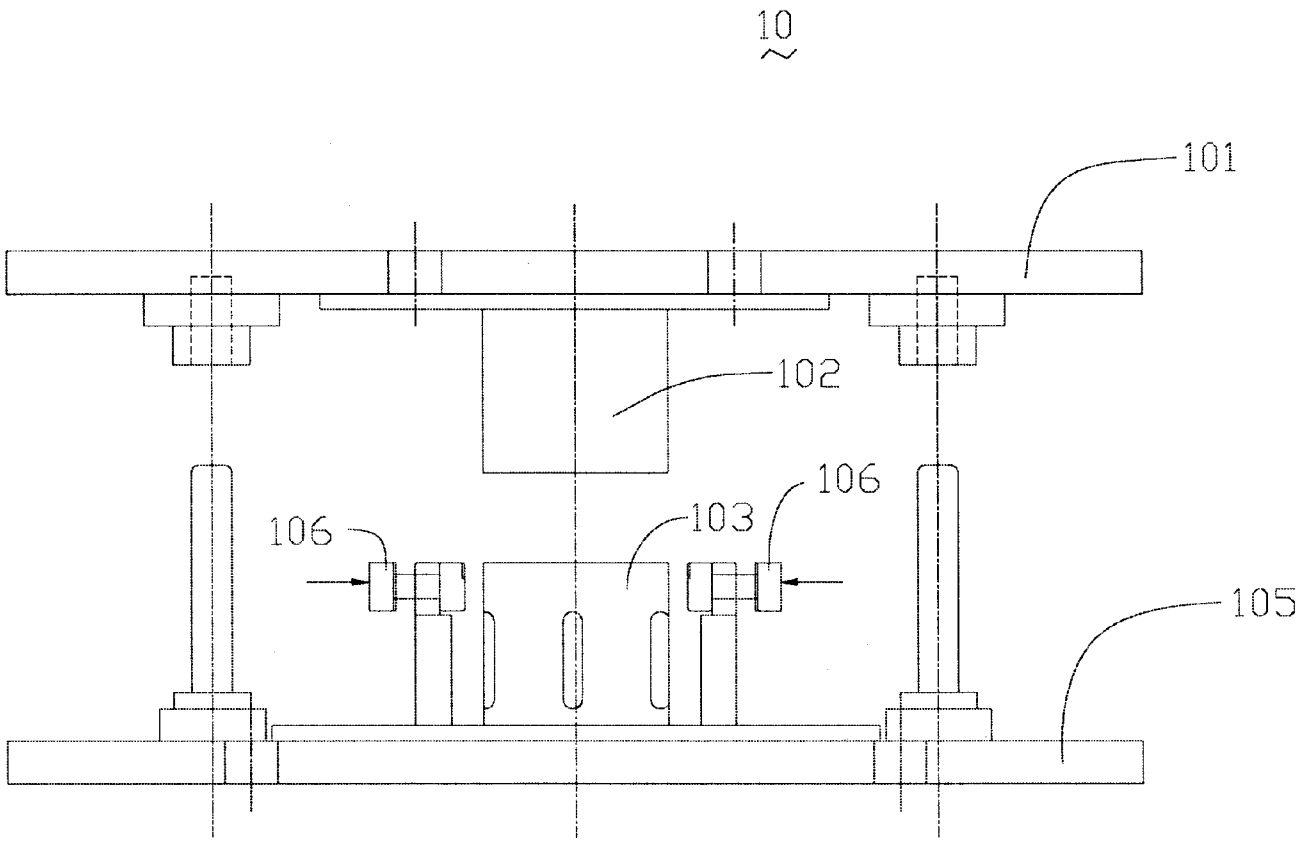
FIG. 6 (PRIOR ART)
FIG. 6 is a schematic view of a conventional die assembly for riveting.

FIG. 5 shows a die assembly 20' for riveting in accordance with an alternative embodiment of the present invention. The die assembly 20' is similar to the die assembly 20. However, the die assembly 20' comprises a longer upper die 200' and a longer base die 230'. This provides enough space for the equivalent of two sets of die assemblies 20 to rivet two workpieces at the same time. Thus production output can be doubled.

The die assembly for riveting of the present invention has at least the following advantages:

1. The die assembly rivets a workpiece by means of pressing force of the upper die, instead of manual force of an operator. Firm riveting is achieved and product quality is enhanced.
2. The springs automatically separate the clamps from the workpiece. It is thus easier to remove the workpiece.
3. The die assembly utilizes the slanted surfaces and the springs to achieve automation, thus increasing production efficiency.

It is understood that the invention may be embodied in other forms without departing from the spirit thereof. Thus, the present example and embodiment are to be considered in all respects as illustrative and not restrictive, and the invention is not to be limited to the details given herein.

I claim:

1. A die assembly for riveting comprising:

an upper die comprising a fixing block and at least one pressing protrusion next to the fixing block, a first slanted surface being formed at the end of the pressing protrusion;

a base die comprising sizing block cooperating with the fixing block adapted to position a workpiece, and at least one supporting block beside the sizing block;

at least one clamp movably attached to the supporting block for pressing the workpiece, the clamp comprising a second slanted surface corresponding to the first slanted surface of the pressing protrusion whereby each clamp is movable from a first position to a second position by the pressing protrusion; and at least one elastic member connected to the clamp whereby each clamp is returnable from the second position to the first position by the elastic member.

2. The die assembly as described in claim 1, wherein the fixing block of the upper die is generally U-shaped, and defines a space for accommodating the workpiece.

3. The die assembly as described in claim 1, wherein a first stepped block is disposed at an outer side of the at least one pressing portion, the first stepped block defining a guiding hole therein, and wherein a second stepped block is disposed on the base die corresponding to the first stepped block of the upper die, the second stepped block having a guiding pin for extending into the guiding hole of the first stepped block.

4. The die assembly as described in claim 1, wherein an upper portion of each supporting block is stepped, and horizontally defines a through hole therein, and the clamp is accommodating in the through hole.

5. The die assembly as described in claim 1, wherein the clamp comprises a press head, an end block, and a connecting portion connecting the press head and the end block and slidable along the through hole, the second slanted surface being at an end portion of the end block.

6. The die assembly as described in claim 1, wherein a positioning block is positioned at an outer side of the supporting block.

7. The die assembly as described in claim 6, wherein an inner side wall of the positioning block is in alignment with an outer side wall of the pressing protrusion, for positioning the pressing protrusion.

8. The die assembly as described in claim 1, wherein the end block of the clamp and the positioning block each includes a bolt for connecting to the elastic member.

* * * * *